United States Patent [19]

LeMarbe

[11] 4,452,149

[45] Jun. 5, 1984

[54] GATE ASSEMBLY UNIT FOR HOPPER-TYPE RAILROAD CAR

[75] Inventor: Edward S. LeMarbe, Plainfield, Ill.

[73] Assignee: Miner Enterprises, Inc., Geneva, Ill.

[21] Appl. No.: 423,950

[22] Filed: Sep. 27, 1982

[51] Int. Cl.[3] ..... B61D 7/00

[52] U.S. Cl. ..... 105/250; 222/509; 105/283; 105/251; 105/282 R

[58] Field of Search ..... 49/339, 345, 363; 222/561, 556, 537, 509, 506, 505; 292/186; 105/283, 250, 251, 282 R, 282 P, 290, 296, 299

[56] References Cited

U.S. PATENT DOCUMENTS

| | | | |
|---|---|---|---|
| 1,097,951 | 5/1914 | Summa | 105/283 |
| 2,126,949 | 8/1938 | Ditchfield | 105/283 |
| 2,888,884 | 6/1959 | Fritz | 222/556 |
| 3,316,859 | 5/1967 | Floehr | 105/299 |

FOREIGN PATENT DOCUMENTS

| | | | |
|---|---|---|---|
| 26287 | of 1910 | United Kingdom | 105/283 |

*Primary Examiner*—H. Grant Skaggs

[57] ABSTRACT

A hopper-type railroad car for transporting ballast used for roadbed restoration includes a set of bottom outlets for discharge of the ballast. Gate assembly units are installed over these outlets to provide regulation of the ballast discharge. Each unit has an inner and outer opening selectively covered by an arcuate shaped door. Each door is connected by linkage to an inner and outer door shaft carried concentrically by the unit. Selective rotation of either shaft moves the respective door to cover or uncover the unit openings to regulate ballast discharge.

4 Claims, 4 Drawing Figures

GATE ASSEMBLY UNIT FOR HOPPER-TYPE RAILROAD CAR

BACKGROUND OF THE INVENTION

1. Field of the Invention:

This invention relates to railroad hopper-type cars for transportation of ballast and more particularly to gate assembly units usable with a bottom outlet in the car body to allow selective discharge of the ballast.

2. Prior Art:

Use of a gate assembly unit to control the discharge of ballast through a bottom outlet in a hopper-type railroad car is well known. Known gate assemblies are disclosed, for example, in U.S. Pat. Nos. 3,645,872, 3,822,650 and 4,009,664.

The gate assembly of the '872 patent is attached to sloped extensions of the ballast car bottom and includes a manually rotatable discharge control member. Rotation of the member allows ballast to fall from an opening and be diverted to either side of a rail in a distribution channel defined by a sidewall and end walls of the control member. The gate assembly of the '650 patent is similar to that disclosed in the '872 patent, except that the discharge control member is formed with a concave discharge plate to define in part its distribution channel. In the '664 patent the gate assembly further includes a locking device to hold the discharge control member in a fixed location.

SUMMARY OF THE INVENTION

A hopper-type railroad car for transporting ballast to a section crew for maintenance on a railroad roadbed has sets of lower outlets formed in a bottom of the hopper car body. One outlet of each set aligns respectively with the rails on which the car is supported.

Associated with each outlet is a gate assembly unit comprising an inner and outer door each having an arcuate door face which may cover an inner and outer discharge opening in the unit. Each door face is positioned on an angle to the ballast load above and is rotatively carried by spaced end walls of the unit. Ends of each door are connected respectively by linkage to both ends of an inner and outer door shaft. One shaft is concentrically carried within the other shaft. Attached to one end of each shaft is a hub prepared to receive an end of an operating bar. Selective manual rotation of the bar rotates the hub which swings the respective door upward allowing a ballast discharge on either or both sides of a rail.

This inventive gate assembly for a hopper-type railroad car has several advantage over gate assemblies heretofore known. First, the gate assembly is a self-contained unit allowing for ready installation to a new hopper-type car or during major maintenance to a car presently in service. Since a car fabricator typically purchases major sub-assemblies for the car i.e., trucks, wheelsets, coupling systems from different manufacturers, being able to purchase the gate assembly as a unit provides certain commercial advantages.

Secondly, ballast may be discharged simultaneously on both sides of both rails or on either side of each rail depending on the needs of the section crew. Additionally, because the doors open upward, ballast is more evenly distributed and does not just collect in a pile on the roadbed below. The amount of labor needed to distribute the ballast before the ballast is tamped between and under the ties is thus kept to a minimum.

Lastly, the doors may be easily opened and closed allowing a more controlled ballast discharge. This ease of operation is provided by operatively connecting each end of each door to its respective shaft allowing the opening and closing forces to be applied uniformly. Equally important is the positioning of the face of the door at an offset angle to the gravitational force of the ballast. Not only does this offset position reduce door loading, but it reduces frictional forces between the door face and the ballast allowing easier door movement. The doors are maintained at a sufficient angle to remain closed. Door opening is inhibited by friction as supplemented by the weight of the door and its associated rotational operating means.

DESCRIPTION OF THE PREFERRED EMBODIMENT

Figure 1:
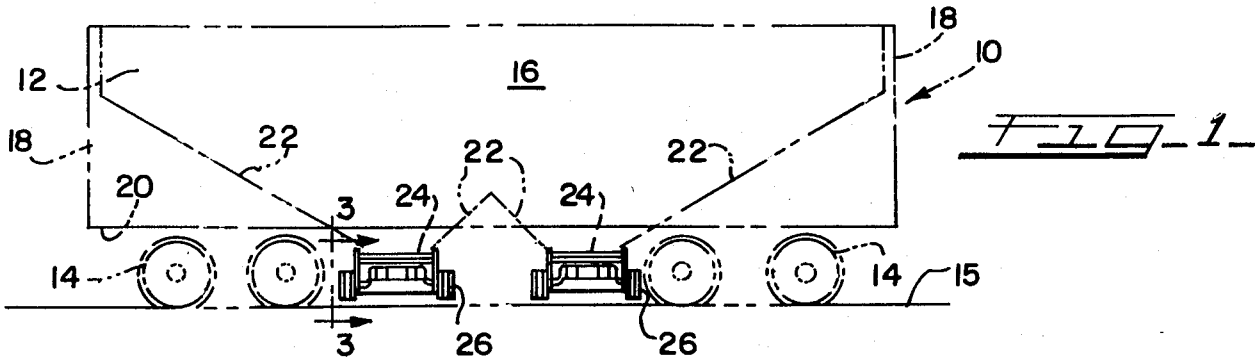
FIG. 1 is a side elevation view of a typical hopper-type railroad car to which gate assembly units of this invention have been installed.

A hopper-type railroad car is shown generally in FIG. 1 and designated 10. The car 10 has a body 12 which is carried on trucks 14, shown pictorially. Wheels of the trucks 14, in turn, are positioned on a pair of rails with one such rail shown and designated 15. The car body 12 is defined by spaced sidewalls with one such sidewall 16 shown and which joints end walls 18. A bottom 20 of the car body 12 includes sets of sheets 22 which slope downwardly and terminate to form outlets 24. It should be understood that the outlets 24 align with the rail 15 while another set of outlets, not shown, align with the other rail, not shown.

Figure 2:
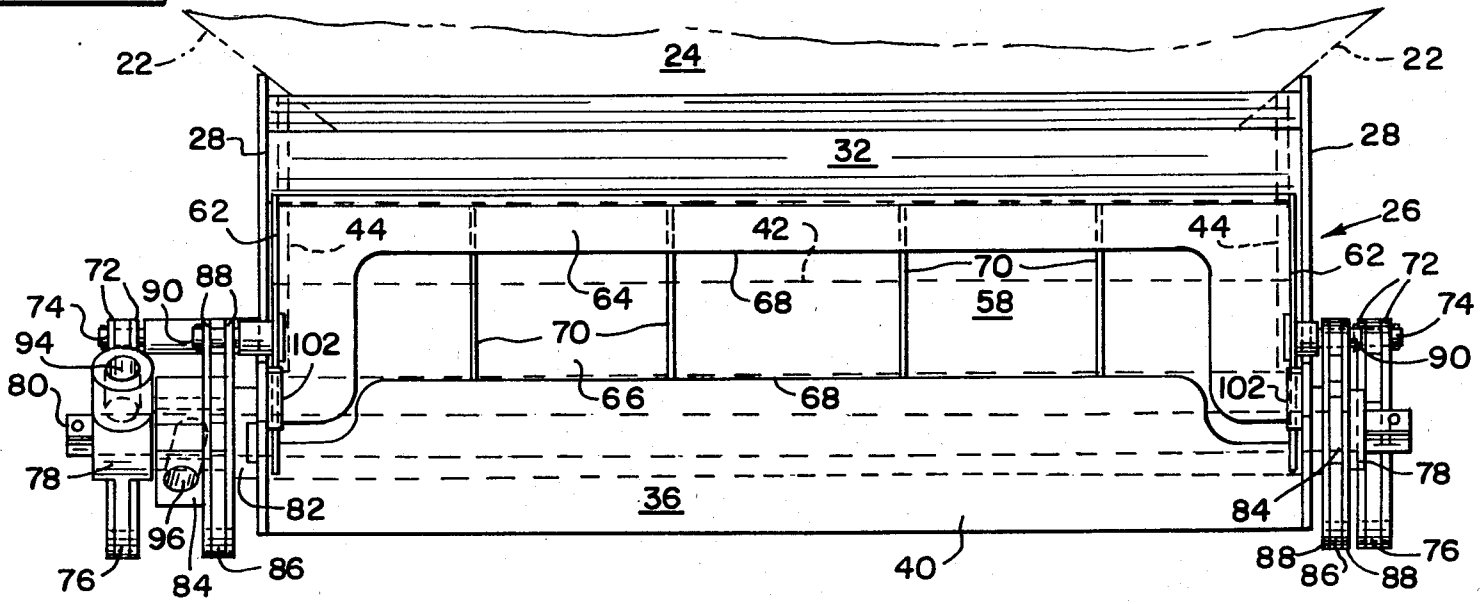
FIG. 2 is a detailed side elevation view of one of the gate assembly units of FIG. 1.

Installed below each outlet 24 is a gate assembly unit 26 of this invention. Because each of the units is substantially similar, only one such unit is described in detail. This description is best understood by viewing FIGS. 2, 3 and 4. The unit 26 comprises a pair of spaced vertical end plates 28 each having an upper portion which connects with an inner and outer angle 30, 32. The angles 30, 32 are offset so that an upper leg portion 34 of each angle 30, 32 aligns with and may be readily fastened to the car bottom sloped side sheets 22. Also attached to the end plates 28 below the inner and outer angles 30, 32 is a divider panel 36 having an inner and an outer channel portion 38, 40 which slope upwardly to form a longitudinal leading edge 42.

Inwardly offset from each end plate 28 is a seal plate 44. Each seal plate 44 has a lower inverted V-shaped cutout 46 which fits over and is attached to the divider panel inner and outer channel portions 38, 40. Each seal plate 44 further includes an inner and outer upper V-shaped cutout 48, 50 which fit about and attach to the inner and outer angles 30, 32. Additionally, each seal plate 44 is formed with an inner and outer arcuate sealing edge 52, 54.

Pivotally attached between the end plates 28 is an inner and outer door 56, 58. Each door 56, 58 has an arcuate door face plate 60 held between door end walls 62 having a triangular configuration. Each door 56, 58 is further defined by a top and a bottom wall 64, 66 having a centrally located partial cutout 68. Spaced gussets 70 are attached intermittently to the door face plates 60 and the top and bottom walls 64, 66 to provide stiffness.

One end of pairs of inner door linkage arms 72 connect respectively with an inner door pivot pin 74 attached one each to the inner door end walls 62. Opposite end of each pair of inner door linkage arms 72 are pivotally connected with a lug portion 76 of an inner door hub 78 affixed to each end of an inner door shaft 80. The inner door hubs 78 are positioned respectively to the outside of the unit end plates 28. The inner door shaft 80, in turn, is journaled concentrically within a hollow outer door shaft 82 which is rotatively carried by the end plates 28.

Attached to each end of the outer door shaft 82, between the inner door hubs 78 and the unit end plates 28, is an outer door hub 84. The outer door hubs 84 each have a lug portion 86 which is pivotally attached to ends of a pair of outer door linkage arms 88. Opposite ends of the pairs of linkage arms 88 connect respectively with outer door pivot pins 90 affixed one each to the end walls 62 of the outer door 58. Note that the outer door pivot pins 90 are shorter in length than the inner door pivot pins 74 allowing the inner door hubs 78 and attached inner door linkage arms 72 to move freely from interference with the outer door hubs 84 and outer door linkage arms 88.

Figure 3:
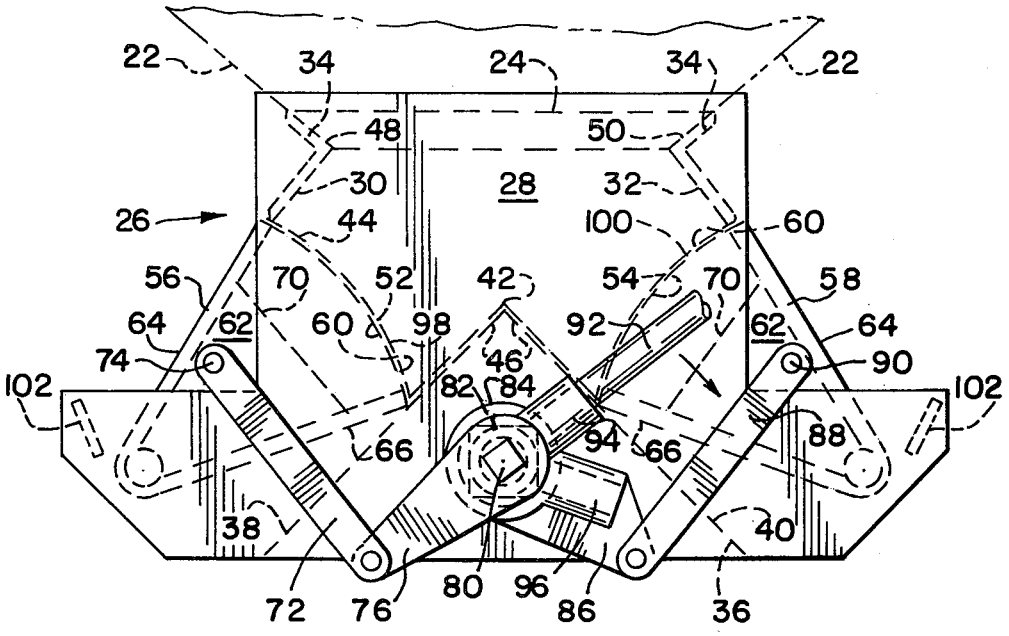
FIG. 3 is an end elevation view of the gate assembly unit as seen generally along the line 3—3 of FIG. 1 and wherein both doors are shown in a closed position.

During operation the hopper car 10 typically will be filled with ballast at a remote location and then be transported to a section of the railroad roadbed undergoing maintenance. During such filling and movement the inner and outer doors 56, 58 of each unit 24 are in a closed position as seen in FIG. 3. Because of the close proximity of the sealing edges 52, 54 of the seal plates 44 and the face plates 60 of each door 56, 58, there is no appreciable loss of ballast. Note that frictional engagement between the door faces 60 and the ballast as supplemented by the weight of the doors 56, 58 and associated rotational means is sufficient to maintain the doors 56, 58 closed.

With the car 10 properly positioned, ballast may be distributed on either the inside or outside of either or both rails. To release the ballast an end of an operating bar 92 is inserted into an inner or outer door tool holding portion 94, 96 formed as part of one of the inner or outer door hubs 78, 84. Rotation of the inner door hub 78 clockwise rotates the inner door shaft 80 so that the inner door linkage arms 72 swing the inner door 56 upward to uncover an inner unit opening 98. A counterclockwise rotation of the outer door hub 84 and the connecting outer door shaft 82 and outer door linkage arms 88 swings the outer door 58 to uncover an outer unit opening 100.

Figure 4:
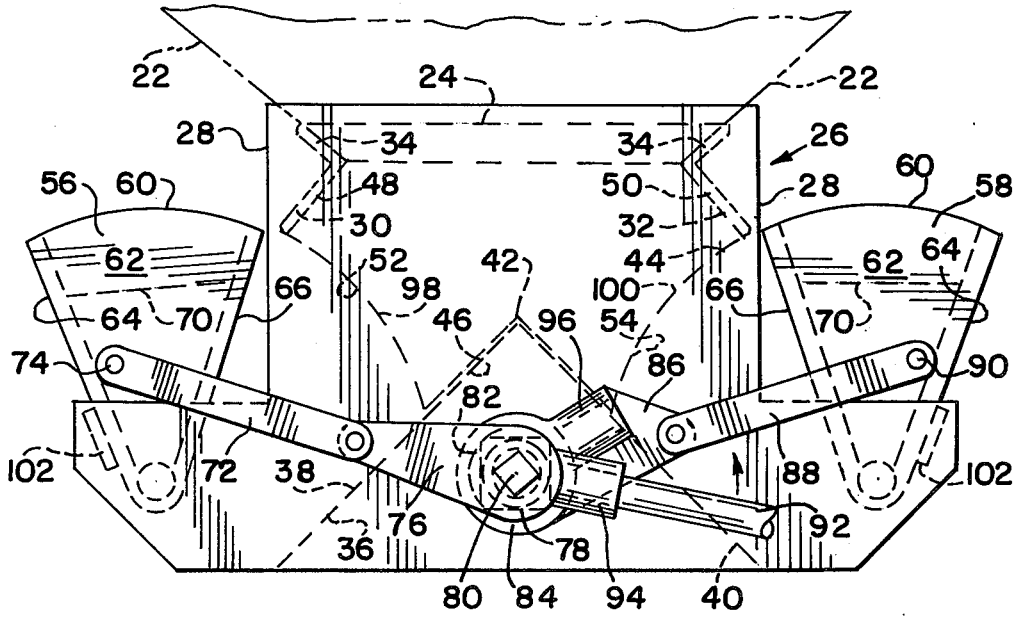
FIG. 4 is similar to FIG. 3, except both doors are shown in an open position.

A 60 degree maximum rotation of either hub 78, 84 moves the respective inner or outer door 56, 58 from a fully closed position, FIG. 3, to a fully open position, FIG. 4. Stops 102 limit further door movement. As the doors 56, 58 open, ballast falls through the car outlet 24 and is divided between the inner and outer openings 98, 100 by the leading edge 42 of the divider panel 36. Incremental increases in door rotation produces a deeper ballast flow so that ballast is distributed incrementally over a wider area of the roadbed rather than merely collecting in a deeper pile. Ballast distribution between the ties is thus kept to a minimum.

Note further that while the ballast produces a considerable gravitational load on the unit 24, this load is only partially transmitted to the doors 56, 58 since the face plate 60 of each door 56, 58 is positioned on an angle to the line of force of the load. Thus the frictional force of the ballast restraining door movement is reduced and is easily overcome by the double-end lifting action on each door 56, 58. This double-end lifting action also inhibits any window locking which would inhibit door movement.

I claim:

1. A hopper-type railroad car adapted to carry ballast or other like particulate material, said car having a body formed with outlets in a bottom of such with said outlets aligning with rails on which said car is carried, and gate assembly units attached to said car body to cover each said outlet and provide selective discharge of said ballast, said gate assembly unit comprising, a pair of spaced end plates, an inner and outer angle connecting with an upper portion of each said end plate with each said angle having a leg portion for attaching to sloped sheets in part defining said car outlet, a divider panel attached between said end plates below said angles, said divider panel having an upper leading edge defining in part an inner and outer opening with said inner and outer angles, and with seal plates attached to said angles and said divider panel immediately inside said end plates, an inner and outer door each pivotally attached to said end plates, each said door having an arcuate face plate located respectively proximate inner and outer sealing edge of each said seal plate, an outer door shaft rotatively carried by said end plates with outer door hubs attached at ends of said shaft, each said hub pivotally attached to an end of said outer door by a linkage arm, and an inner shaft concentrically journaled within said outer door shaft, said inner shaft having ends extending beyond said outer door hubs to carry inner door hubs, each said inner door hub pivotally attached to an end of said inner door by a linkage arm, wherein selective rotation of said inner or outer door shaft moves said inner or outer door to uncover said inner or outer unit opening respectively allowing distribution of ballast on either an inside, an outside, or both sides of a rail.

2. A self-contained gate assembly unit adapted for use with a hopper-type railroad car to regulate a flow of ballast from a bottom outlet in said car, said gate assembly unit comprising, end plates spaced apart to locate outside ends of said car outlet, an inner and outer angle connecting with an upper portion of each said end plate, said angles having leg portions positioned for attachment to sloped sheets defining an inner and outer side of said outlet, a divider panel carried by said end plates below said angles with said panel having upward sloped channels joining to form a leading edge, a pair of seal plates attached to said angles and said divider panel and located one each on an inside of said end plates with each said plate formed with an inner and outer arcuate sealing edge, said seal plates, said angles and said divider panel leading edge defining an inner and outer opening in said unit, an inner door shaft journaled within an outer door shaft having ends pivotally carried by said end plates, said outer door shaft having ends extending beyond said end plates for attachment of outer door hubs, and ends of said inner door shaft extending beyond said outer door hubs for attachment of inner door hubs, an inner and outer door each having ends pivotally attached to said end plates, each said door having an arcuate face plate located proximate to said inner and outer sealing edges of said seal plates respectively, and pairs of inner and outer door linkage arms having ends pivotally joined to lug portions formed as part of said inner and outer door hubs with opposite ends of said linkage arms connecting with pivot pins affixed to ends of said inner and outer door respectively, wherein selective rotation of said inner door shaft and said outer door shaft swing said respective doors to cover or uncover said unit inner and outer opening.

3. A gate assembly unit as defined by claim 2 and further characterized by, said car outlet aligning with at least one of said rails, and said inner and outer unit opening providing for a distribution of ballast to an inside and outside of said rail, respectively.

4. A gate assembly unit as defined by claim 2 and further characterized by, said linkage arms and said attached lug portions of said inner and outer door hubs positioned to fully cover or uncover said unit openings with a 60 degree maximum rotation of said respective shafts.

* * * * *